US005459885A

United States Patent [19]

Gaw

[11] Patent Number: 5,459,885

[45] Date of Patent: Oct. 24, 1995

[54] DUAL FLUSH MECHANISM FOR A TOILET

[76] Inventor: Stanley E. Gaw, 124 Berwick Pl., Lansdale, Pa. 19446

[21] Appl. No.: 240,872

[22] Filed: May 11, 1994

[51] Int. Cl.[6] ..... E03D 1/14

[52] U.S. Cl. ..... 4/325

[58] Field of Search ..... 4/324, 325, 326, 4/405, 411, 412

[56] References Cited

U.S. PATENT DOCUMENTS

| | | | |
|---|---|---|---|
| 2,950,483 | 8/1960 | Richards | 4/325 |
| 3,936,889 | 2/1976 | Wibroe | 4/325 |
| 3,964,109 | 6/1976 | Street et al. | 4/67 |
| 4,025,968 | 5/1977 | Davis | 4/67 |
| 4,067,074 | 1/1978 | Harrison | 4/324 |
| 4,141,092 | 2/1979 | Jones | 4/324 |
| 4,328,596 | 5/1982 | Renz | 4/324 |
| 4,411,029 | 10/1983 | Huang | 4/325 X |
| 4,483,024 | 11/1984 | Troeh | 4/324 |
| 4,881,279 | 11/1989 | Harney | 4/324 |
| 4,969,218 | 11/1990 | Comparetti | 4/325 |
| 5,153,948 | 10/1992 | Smith et al. | 4/415 |
| 5,206,960 | 5/1993 | Hooshley et al. | 4/325 |

*Primary Examiner*—Charles E. Phillips
*Attorney, Agent, or Firm*—Eric A. LaMorte

[57] ABSTRACT

A flush control mechanism for a toilet and associated method that enables the toilet to be flushed with either a long flush cycle for solid wastes or a short flush cycle for liquid wastes. The present invention includes a nonbouyant flush valve that controls the duration of the flush cycle. A handle assembly is provided that is rotatably manipulative around its longitudinal axis from a set orientation to a rotated orientation. The handle assembly is also reciprocally manipulative along its longitudinal axis from an extended position to a retracted position. A first mechanism is coupled to the handle assembly and the flush valve for temporarily maintaining the flush valve in an open condition when the handle assembly is rotated into its rotated orientation. The flush valve remains open until the tank drains to a first level. A second mechanism is coupled to the handle assembly for temporarily maintaining the flush valve in an open condition when the handle assembly is manipulated into its retracted position and is rotated into its rotated orientation. The second mechanism acts to hold the flush valve open until the tank drains to a second level or empties completely.

9 Claims, 4 Drawing Sheets

DUAL FLUSH MECHANISM FOR A TOILET

BACKGROUND

1. Field of the Invention

The present invention relates to the flush mechanisms used in toilets. More specifically, the present invention relates to flush mechanisms that can be used to selectively create a short flush cycle for liquid waste and a long flush cycle for solid waste, thereby conserving water.

2. Prior Art Description

The primary cause of domestic water use is the operation of the toilet. Due to the frequency and scale of recent water shortages, considerable interest has been focused upon limiting the amount of water a toilet uses.

Over the years, many devices for reducing the flush volume of a toilet have been invented. The simplest such method is to place water displacing objects into the toilet tank. However, in many cases, this approach is problematic due to the limited space available in the toilet tank and the interference created with the arrangements of the tank hardware. Another approach to saving water is to provide the toilet with two flush cycles. A long flush cycle is used to remove solid wastes and a short flush cycle is used to remove liquid wastes. Such prior art is exemplified by U.S. Pat. No. 3,964,109 to Street et al., entitled FLUSH VALUE ASSEMBLY; U.S. Pat. No. 4,881,279 to Harney, entitled DUAL FLUSH MECHANISM; U.S. Pat. No. 4,141,092 to Jones, entitled DUAL-FLUSH, TANK ACTUATING DEVICE; and U.S. Pat. No. 4,483,024 to Troeh, entitled VARIABLE FLUSH WATER CLOSET.

However, there are several disadvantages to such prior art variable flush mechanisms. Many prior art devices are structurally unreliable and cannot be used in a domestic setting. Other prior art devices only fit limited tank configurations, while others require specialized overflow stack and valve seat assemblies. The most common disadvantage embodied by prior art devices is that they do not encourage the use of the short flush cycle, have no adjustments or have only short flush cycle adjustments. Similarly, many such prior art devices are difficult to install or too costly for general use.

The need therefore exists in the art for a toilet flush device that provides an inducement to use the short flush cycle, easy to install and is cost effective.

The need also exists for a toilet flush device that has easily adjusted long flush and short flush cycles so the device can be adjusted to the needs of the user.

SUMMARY

The present invention is a flush control mechanism for a toilet and associated method that enables the toilet to be flushed with either a long flush cycle for solid wastes or a short flush cycle for liquid wastes. The present invention includes a nonbouyant flush valve that controls the duration of the flush cycle. A handle assembly is provided that is rotatably manipulative around its longitudinal axis from a set orientation to a rotated orientation. The handle assembly is also reciprocally manipulative along its longitudinal axis from an extended position to a retracted position. A first mechanism is coupled to the handle assembly and the flush valve for temporarily maintaining the flush valve in an open condition when the handle assembly is rotated into its rotated orientation. The flush valve remains open until the tank drains to a first level. A second mechanism is coupled to the handle assembly for temporarily maintaining the flush valve in an open condition when the handle assembly is manipulated into its retracted position and is rotated into its rotated orientation. The second mechanism acts to hold the flush valve open until the tank drains to a second level or empties completely.

Both the first mechanism and the second mechanism are adjustable. As such, the amount of water released in either the short flush cycle or the long flush cycle can be selectively adjusted to meet the needs of the user.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
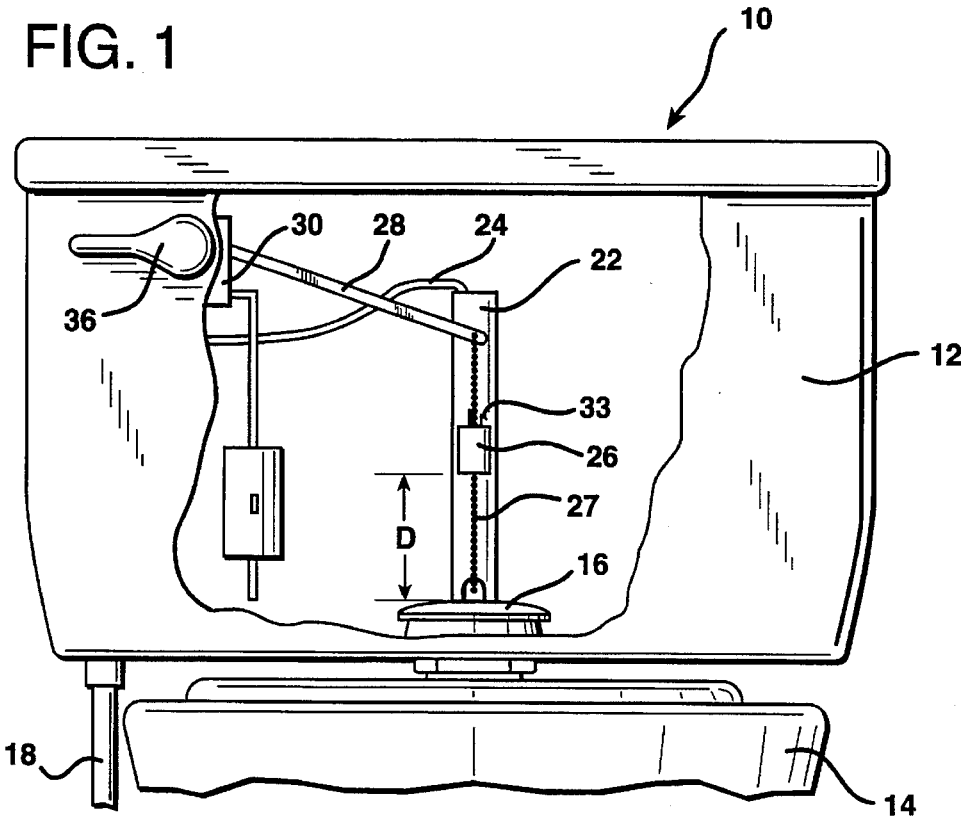
FIG. 1 is a segmented forward view of one preferred embodiment of the present invention flush mechanism shown in conjunction with a toilet tank and bowl to promote consideration and discussion.

Referring to FIG. 1, there is shown one preferred embodiment of the present invention flush mechanism installed within a common toilet 10. As with most toilets, the shown embodiment includes a flush tank 12 and a bowl 14. The flush tank 12 retains a predetermined volume of water that is released into the bowl 14 when the flush valve 16 between the flush tank 12 and the bowl 14 is opened. The flush tank 12 refills when the flush valve 16 closes. Water is supplied by the water inlet pipe 18, whereby the flush tank 12 is again filled with the predetermined volume of water. The filling of the flush tank 12 is controlled by the inlet valve assembly 21 (shown in FIG. 2), overflow assembly 22 and fill tube 24 which are all well known components of a conventional prior art toilet.

In the present invention, the flush valve 16 is not buoyant. As such, gravity and water pressure bias the flush valve 16 into a closed position that prevents water from flowing into the bowl 14 from the flush tank 12. The flush valve 16 is coupled to an elongated flush activation arm 28 via a flexible connecting element 27. A flush float 26 is coupled to the flexible connecting element 27 at a distance D from the flush valve 16. The flush float 26 is sized to provide a buoyant force to the flush valve 16 that is sufficient to maintain the flush valve 16 in an open position, once the flush valve 16 is open, however, the buoyant force is not sufficient to open the flush valve 16 when it is closed. A clip 33 is disposed on the upper surface of the flush float 26. The clip 33 selectively engages the flexible connecting element 27 at any point along its length. As such, the distance D between the flush valve 16 and the flush float 26 can be selectively adjusted for a purpose which will be later explained.

The flush activation arm 28 extends from the flush control assembly 30. As will be later explained, the flush control assembly 30 is controlled by the various different manipulations of the handle 36, whereby the flush valve 16 can be lifted for a short period of time (i.e. short flush), where only a small amount of the flush tank 12 is drained, or the flush valve 16 can be lifted for a long time (i.e. long flush), where a larger portion of the flush tank 12 is drained.

Figure 2:
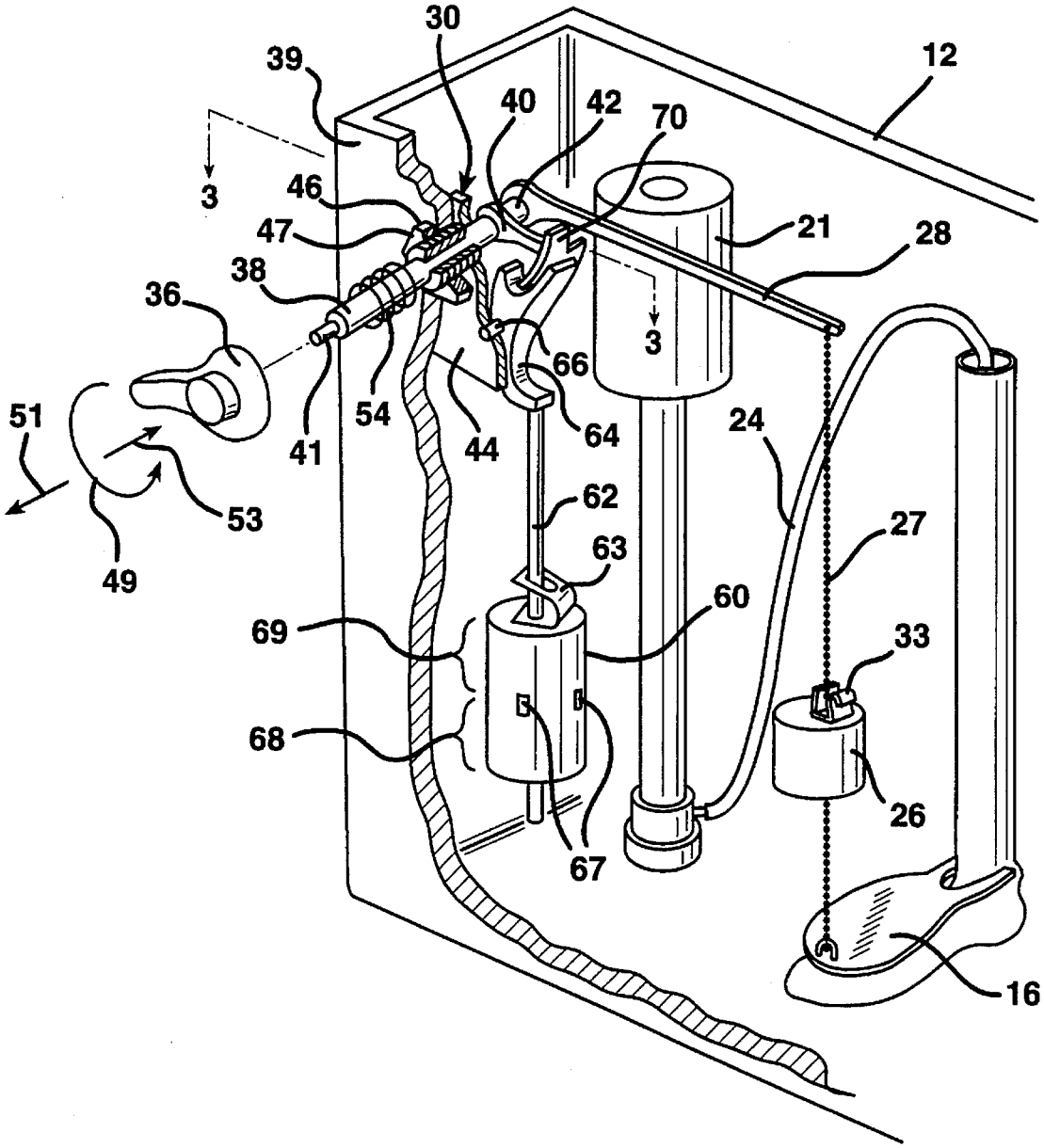
FIG. 2 is a perspective view of the embodiment shown in FIG. 1 with selected segmentation to better show the components contained therein.
Figure 3:
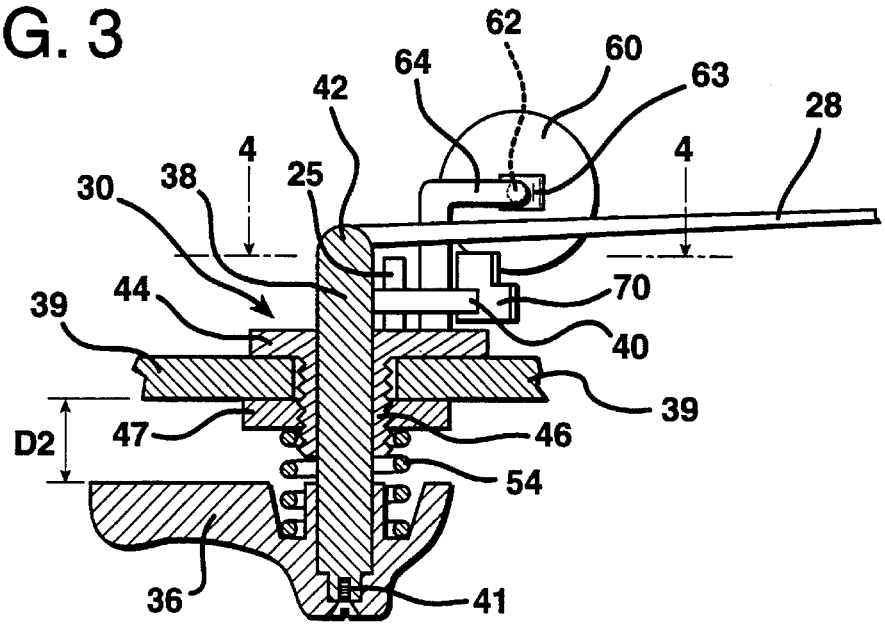
FIG. 3 is a cross-sectional view of the embodiment shown in FIG. 2, viewed along section line 3–3.

Referring to FIG. 2 in conjunction with FIG. 3, it can be seen that the flush control assembly 30 includes a shaft 38 that extends through the forward wall 39 of the flush tank 12. The proximal end 41 of the shaft 38 is shaped to receive the handle 36. The distal end 42 of the shaft 38 is coupled to the flush activation arm 28 so that the flush activation arm 28 extends substantially at a perpendicular from the longitudinal axis of the shaft 38. As a result, it should be understood that by rotating the handle 36, the shaft 38 can be rotated and the flush activation arm 28 can be caused to lift the flush valve 16 from the shown closed position into an open position.

A control bar 40 also extends from the shaft 38 at a point within the flush tank 12. The control bar 40 is firmly affixed to the shaft 38, as such, the control bar 40 also turns as the handle 36 is turned and the shaft 38 turns. The shaft 38 passes through a support member 44. The support member 44 includes a threaded element 46 that extends through the forward wall 39 of the flush tank 12 and is engaged by a locking nut 47. As a result, the support member 44 is firmly anchored to the forward wall 39 of the flush tank 12. The shaft 38 extends through the center of the threaded element 46 of the support member 44. However, the shaft 38 is not engaged by the support member 44. As a result, the shaft 38 is free to rotate independently of the support member 44 along the arcuate path of arrow 49. Similarly, the shaft 38 is also free to move reciprocally back and forth in the directions of arrows 51 and 53. Two stops 23, 25 extend outwardly from the support member 44. The control bar 40 is disposed between the two stops 23, 25. As a result, the contact between the stops 23, 25 and the control bar 40 define the range across which the shaft 38 can be rotated. The reciprocal movement of the shaft 38, however is limited in the direction of arrow 51 by the contact between the control bar 40 and the support member 44. Adversely, the reciprocal movement of the shaft 38 is limited in the direction of arrow 53 by the contact between the handle 36 and the threaded element 46 of the support member 44.

A spring 54 is disposed around the shaft 38 on the outside of the flush tank 12 between the handle 36 and the locking nut 47. The spring 54 biases the handle 36 into a position that is a distance D2 from the forward wall 39 of the flush tank 12.

A second flush float 60 is also present within the flush tank 12. The second flush float 60 is positioned on a rod 62. A clip 63 joins the second flush float 60 to the rod 62 so that the second flush float 60 can be selectively positioned at any point along the rod 62. The rod 62 joins to a pivot assembly 64 that rotates around a pivot pin 66. The pivot pin 66 is a small structure that extends out of the support member 44. Apertures 67 are formed in the second flush float 60. As a result, when the second flush float 60 is submerged, the lower portion 68 of the second flush float 60 is flooded while the upper portion 69 of the second flush float 60 retains a cushion of air.

Figure 4:
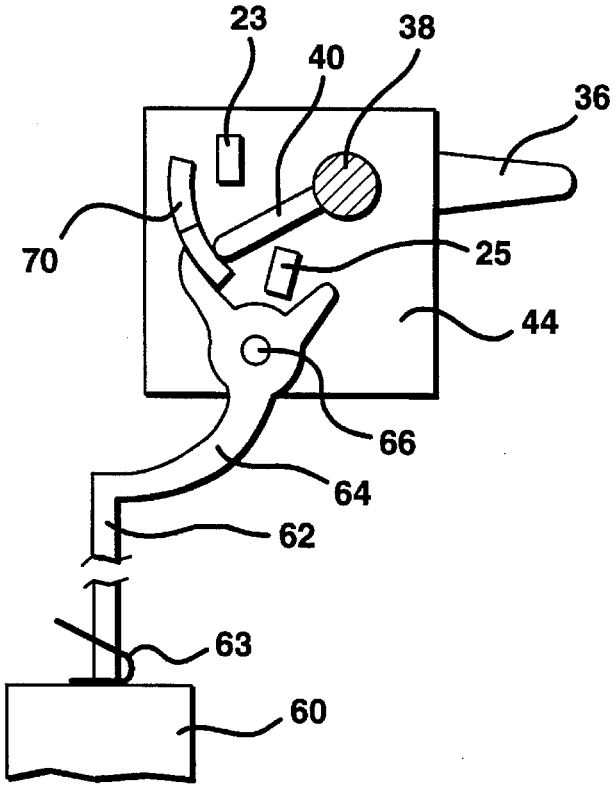
FIG. 4 is a cross-sectional view of the embodiment shown in FIG. 3, viewed along section line 4—4.

A contact plate 70 is disposed on the pivot assembly 64. Referring to FIG. 4, it can be seen that the contact plate 70 is curved to generally match the arcuate path traveled by the distal end of the control bar 40 that extends from the shaft 38. When the second flush float 60 is submerged, the second flush float 60 creates a buoyant force that pushes the rod 62 upward. This action causes the pivot assembly 64 to pivot in a clockwise direction around pivot pin 66. This rotation biases the contact plate 70 against the control bar 40 wherein the contact plate 70 abuts against the control bar 40.

Figure 5:
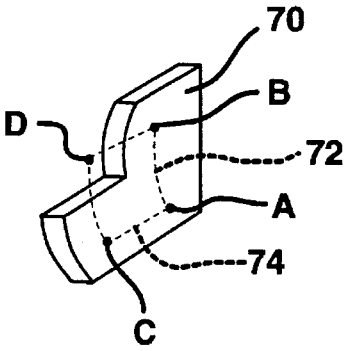
FIG. 5 is an isolated view of the contact plate component of the present invention.

Referring to FIG. 5, a segment view of the contact plate 70 is shown. As can be seen, the contact plate 70 is shaped like a curved square having the upper left most quadrant removed.

OPERATION

In FIG. 3, the handle 36 is shown biased into a set position by spring 54 and the weight of the flush activation arm 28. Returning to FIGS. 4 and 5, it will be understood that when the handle 36 is at this nominal set position, the control bar 40 contacts the contact plate 70 at point A (FIG. 5). As a person turns the handle 36 to flush the toilet, the control bar 40 moves from point A to point B along line 72. The weight of the flush activation arm 28 provides a rotational bias to shaft 38 that acts to return the shaft 38 to its nominal position. Consequently, once the handle 36 is released, the control bar 40 immediately returns to point A from point B.

Looking to FIG. 2, it will be understood that the turning of the handle 36 in the manner just described, rotates the flush activation arm 28 to lift the flush valve 16 into an open position. Once open, the first flush float 26 holds the flush valve 16 open until the water in the flush tank 12 drops below the level of the first flush float 26. Gravity then causes the flush valve 16 to close and the flush tank refills. Since the first flush float 26 is suspended at a point near the middle of the flush tank 12, it will be understood that only some of the water in the flush tank 12 is released before the flush valve 16 again closes. It will therefore also be understood that by selectively adjusting the distance D (FIG. 1) between the first flush float 26 and the flush valve 16 the length of the short flush can be selectively controlled.

To perform a long flush, the handle 36 is pushed forward toward the flush tank 12 and against the bias of the spring 54. This causes the control bar 40 to move from nominal point A to point C along line 74 (see FIG. 5). Once pressed into point C, if the handle is turned, the control bar 40 moves to point D from point C. Once at this location, the contact plate 70 no longer engages the control bar 40. Additionally, the rotation of the handle causes the flush activation arm 28 to lift the flush valve 16 to an open position as previously described.

Figure 6:
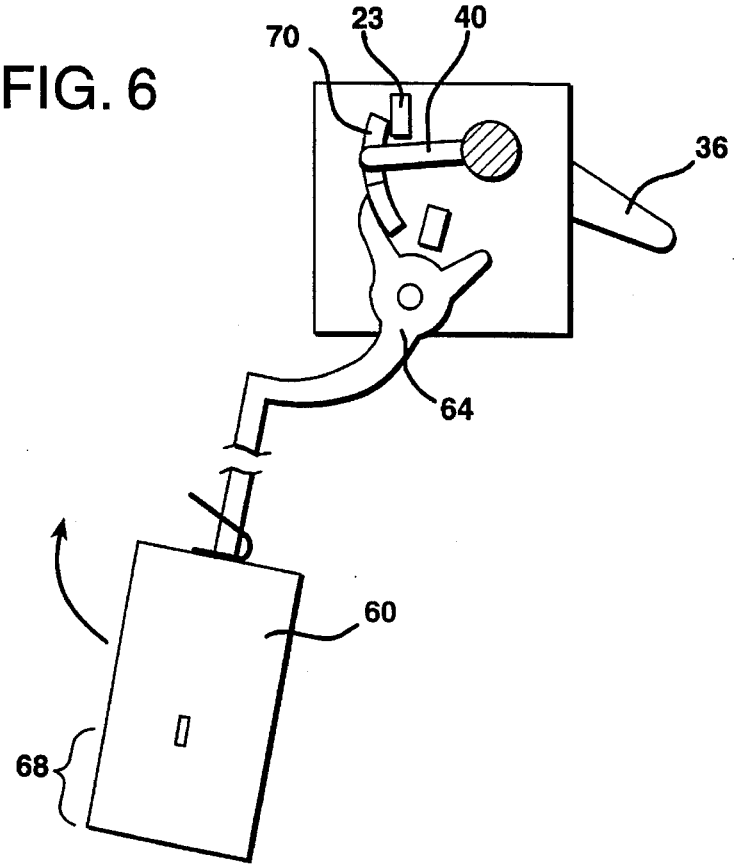
FIG. 6 is a cross-sectional view of the embodiment shown in FIG. 3, viewed along section line 4—4, shown during a long flush cycle.

Referring to FIG. 6, it can be seen that when the control bar 40 is at point D (FIG. 5) and does not abut against the contact plate 70, there is nothing present to stop the rotation of the pivot assembly 64. Accordingly, the buoyant force created by the second flush float 60 rotates the pivot assembly 64 clockwise as shown, and the contact plate 70 passes under the control bar 40. Once the handle 36 is released, the presence of the contact plate 70 under the control bar 40 prevents the control bar 40 from rotating back to its nominal starting position. As such, the control bar 40 is maintained at an elevated position, thereby causing the flush activation arm 28 (FIG. 2) to be maintained at an elevated position. The flush activation arm 28 therefore holds the flush valve 16 open even after the water level descends below the level of the first flush float 26.

As the water level within the flush tank 12 descends below the level of the second flush float 60, the buoyant force is removed and the weight of the second flush float 60 causes the pivot assembly 64 to rotate counterclockwise. The weight of the second flush float 60 is increased by the water trapped in the lower portion 68 of the flush float 60. As the pivot assembly 64 rotates counterclockwise, the contact plate 70 moves out from below the control arm 40. The control arm 40 then returns to position A (FIG. 5) and the flush activation arm 28 allows the flush valve 16 to close. The flush tank 12 then refills and the toilet is ready for another long flush or short flush. It will also be understood that by varying the position of the second flush float 60, the length of the long flush and thus the volume of water drained can be selectively controlled.

Figure 7:
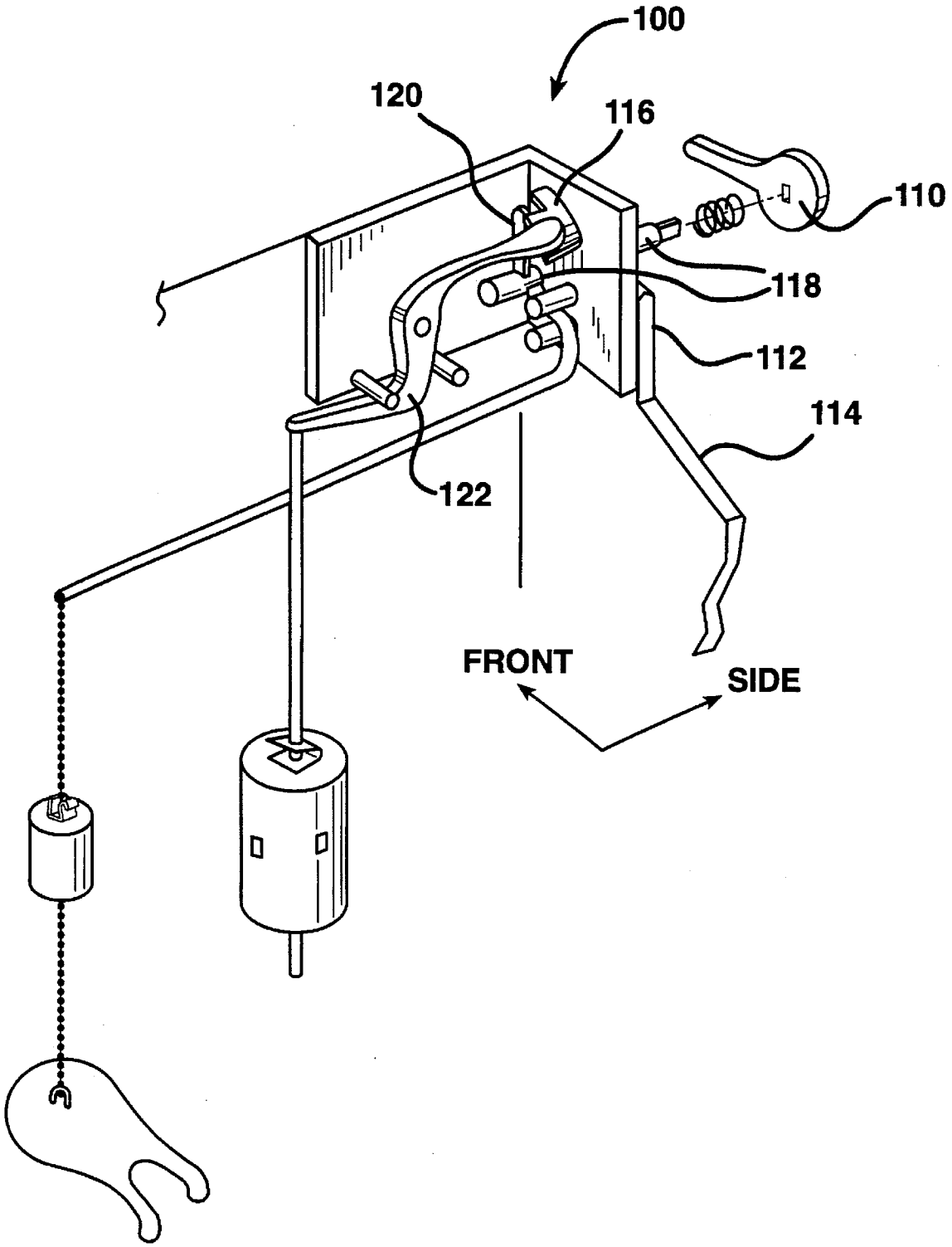
FIG. 7 shows an alternate embodiment of the present invention flush mechanism.

Referring to FIG. 7, an alternate embodiment of the present invention 100 is shown. In this embodiment, the handle 110 extends out of the side wall 112 of a toilet's flush tank 114. The shown embodiment works in the same manner as the embodiment of FIGS. 1–6, however the contact plate 116 is now oriented above the shaft 118 and the control bar 120 extends upwardly to engage the contact plate 116. The pivot assembly 122 is shaped to compensate for the change in orientations, however the operation of the overall assembly remains the same as has been previously explained.

It will be understood that the present invention flush control apparatus described in conjunction with the various drawings is merely exemplary and a person skilled in the art of flush mechanisms may make numerous variations and modifications to the shown embodiments utilizing functionally equivalent components to those described. All such variations and modifications are intended to be included within the scope of the invention as defined by the appended claims.

What is claimed is:

1. In a toilet having a flush tank and a bowl, a flush control device, comprising:

a nonbouyant flush valve positionable between an open condition and a closed condition, wherein said flush valve regulates the flow of water from the tank to the bowl;

at least one first float coupled to said flush valve, wherein said at least one first float is disposed at a first depth in the tank and provides a first buoyant force when submerged that is sufficient to maintain said flush valve in said open condition but is insufficient to change said flush valve from said closed position to said open condition;

an elongated member extending through a wall of the tank, said elongated member having a longitudinal axis wherein said elongated member is rotatably manipulable around said longitudinal axis from a set orientation to a rotated orientation and said elongated member is reciprocally manipulated along said longitudinal axis from an extended position to a retracted position;

a flush arm member affixed to said elongated member, said flush arm member being coupled to said flush valve, whereby said flush arm member causes said flush valve to change from said closed position to said open position when said elongated member is rotated from set orientation to said rotated orientation;

at least one second float disposed at a second depth in the tank that is lower than said first depth of said at least one first float, wherein said at least one second float provides a second buoyant force when submerged;

engagement means coupled to said at least one second float, wherein said second buoyant force of said at least one second float causes said engagement means to act upon said elongated member and prevent said elongated member from returning from said rotated orientation to said set orientation when said elongated member is manipulated to said rotated orientation and said retracted position, whereby said flush valve is held in said open condition until said at least one second float is no longer submerged.

2. The device according to claim 1, further including a means for biasing said elongated member into said set orientation and said extended position.

3. The device according to claim 1, further including a means for selectively adjusting said first depth of said at least one first float.

4. The device according to claim 3, further including a means for selectively adjusting said second depth of said at least one second float.

5. The device according to claim 1, further including a control arm member affixed to said elongated member, wherein said engagement means engages said control arm member thereby causing said engagement means to act upon said elongated member.

6. A flush control device for a toilet tank, comprising:

a handle assembly manipulative between both a first rotated position 5 and a second rotated position and an extended position and a retracted position;

a flush valve positionable between an open condition and a closed position;

first means coupled to said handle assembly and said flush valve for temporarily maintaining said flush valve in said open condition, when said handle assembly is manipulated to said second rotated position, until the fluid level of the tank drains to a first level;

second means coupled to said handle assembly for temporarily maintaining said flush valve in said open condition, when said handle assembly is manipulated to said second rotated position and said retracted position, until the fluid level of the tank drains to a second level lower than said first level; and first adjustment means for adjusting the depth of said first level.

7. The device according to claim 6, wherein said flush valve is nonbouyant and said first means includes a float coupled to said flush valve that is capable of maintaining said flush valve in said open condition when submerged, but is incapable of moving said flush valve from said closed position.

8. The device according to claim 6 further including a second adjustment means for adjusting the depth of said second level.

9. The device according to claim 6, further including a spring means for biasing said handle assembly into said extended position.

* * * * *